US008381449B1

(12) United States Patent
Hodgetts et al.

(10) Patent No.: US 8,381,449 B1
(45) Date of Patent: Feb. 26, 2013

(54) MODULAR ROOF STRUCTURAL UNITS AND USE THEREOF

(76) Inventors: Craig Hodgetts, Los Angeles, CA (US); HsinMing Fung, Los Angeles, CA (US)

( * ) Notice: Subject to any disclaimer, the term of this patent is extended or adjusted under 35 U.S.C. 154(b) by 0 days.

(21) Appl. No.: 13/360,500

(22) Filed: Jan. 27, 2012

Related U.S. Application Data

(60) Provisional application No. 61/437,136, filed on Jan. 28, 2011.

(51) Int. Cl.
*E04H 14/00* (2006.01)

(52) U.S. Cl. ..... 52/1; 52/80.2

(58) Field of Classification Search ..... 52/1, 84, 52/80.1, 18, 80.2
See application file for complete search history.

(56) References Cited

U.S. PATENT DOCUMENTS 428,494 A * 5/1890 Kick ..... 52/18
1,182,082 A * 5/1916 Fouts ..... 52/262
3,179,462 A * 4/1965 Hagen ..... 296/157
3,535,836 A * 10/1970 Blaski ..... 52/80.1
3,984,950 A * 10/1976 Hildebrand et al. ..... 52/79.7
3,990,208 A * 11/1976 Henderson ..... 52/745.08
4,505,069 A * 3/1985 Freeman ..... 49/64
4,899,503 A * 2/1990 Baughman et al. ..... 52/171.3
7,325,475 B2 * 2/2008 Long ..... 89/36.08
7,488,030 B2 * 2/2009 Nadeau ..... 296/172
8,082,698 B2 * 12/2011 Drake ..... 52/79.5
2005/0235819 A1 * 10/2005 Long ..... 89/36.07

* cited by examiner

*Primary Examiner* — Basil Katcheves
(74) *Attorney, Agent, or Firm* — Patent Law & Venture Group; Gene Scott

(57) ABSTRACT

A building structure has a generally horizontally disposed modular roof made-up of a plurality of side-by-side roof units which are mutually joined. Each roof unit is constructed as a pair of spaced apart rigid skins shaped in such manner as to eliminate additional supporting structure and which are joined along mutual edges of the pair of skins and forming an interior space filled with a thermal insulator. One end of each of the roof units is curved in a downward arc. A skylight frame protrudes above an upper one of the pair of skins, the frame supporting an upwardly facing window. An electrical circuit includes LED lamps mounted in a lower one of the pair of skins with its illumination directed downwardly. The circuit may also include a motorized shade or a liquid crystal shade for limiting natural light transmission through the window.

5 Claims, 7 Drawing Sheets

MODULAR ROOF STRUCTURAL UNITS AND USE THEREOF

CROSS-REFERENCE TO RELATED APPLICATIONS

This application is a continuation based on a prior filed provisional patent application 61/437,136, filed on Jan. 28, 2011 and claims international date priority therefrom. The subject matter of application 60/603,444 is hereby incorporated herein in its entirety.

STATEMENT REGARDING FEDERALLY SPONOSORED RESEARCH OR DEVELOPMENT

Not Applicable

REFERENCE TO SEQUENCE LISTING, A TABLE, OR A COMPUTER PROGRAM USING COMPACT DISC APPENDIX

Not Applicable

BACKGROUND OF THE DISCLOSURE

This disclosure relates to the field of building structures and more particularly to modular roof structural units. Such units may be mutually engaged with a building structure as a number of mutually joined portions resulting in a unitary structure such as a complete roof. Modular buildings and building parts use sectional prefabricated units that may be portions of a building or the entire building and generally consist of multiple modules or sections which are manufactured in a remote facility and then delivered to their intended site of use. Such modules are assembled on-site forming a building structure which may be placed using cranes, fork-lift trucks, and similar equipment.

Modular structures have a variety of uses. They may be part of long-term, temporary or permanent facilities, such as construction camps, schools and classrooms, civilian and military housing, and industrial facilities. Such modules are used in remote and rural areas where conventional construction may not be reasonable or possible. Uses have included churches, health care facilities, sales and retail offices, and fast food restaurants. Modular components are typically constructed indoors on assembly lines. The well-known advantages of this approach include improved uniformity and efficiency in materials, assembly processes, quality control and inspection. Modular building structures and components are generally more cost effective than the conventional assembly-on-site approach. Production schedules are more easily met since weather is not a factor and this benefits rate of production as well. Typically, independent building inspectors are on site to supervise construction and ensure that all building codes are adhered to during assembly. Once assembled, modular structures are essentially indistinguishable from conventional site-built structures. While modular manufactured buildings may depreciate in value over time, a well-built modular building can have the same, or even greater longevity as its site-built counterpart.

U.S. Pat. No. 3,664,254 issued to Henson et al discloses a modular system for industrial buildings, garages, car washing facilities and the like, which is adapted to serve the two-fold function of providing a roof structure for such buildings and may contain the heating, cooling, ventilating, and air conditioning equipment for the buildings. More particularly, the disclosure is directed to a new and improved modular roof system consisting of a series or plurality of individual roof modules which preferably, although not necessarily, extend transversely or laterally over an associated building and are arranged in an edge to edge abutting relationship so as to provide a complete roof structure for the building. In accordance with the principles of this disclosure, the modular system is adapted for various styles of building architecture, with the system finding particularly useful application in the well-known hip roof, mansard roof, flat roof, and peak or gable roof architectural styles. Accordingly, the invention provides a modular roof structure that is both extremely functional in operation and aesthetically appealing. A particular feature of the invention resides in the fact that the various modules constituting the roof structure of a building may be arranged along the length of a building so as to best adapt a particular building structure for its intended use.

BRIEF SUMMARY OF THE DISCLOSURE

The presently described apparatus incorporates many of the features of the Henson et al disclosure and goes beyond to present a highly novel arrangement of elements and features not found in the prior art. This apparatus is a modular roof structure made up of individual modules or units having a doubly-curved monocoque design and a range of specific possible adaptations according to intended use or application. The units are particularly adapted for schoolrooms, yet are also very broadly useful in many alternative applications. The units are meant to be used in multiples. Each unit consists of a single piece, molded, stressed-skin fiberglass shell with foamed-in-place insulation which eliminates traditional beams, purlins, and sheathing, thus producing significant savings in materials. Integral skylight openings are part of the shell formation which also provides for drainage of rain and snow or ice off the top surface as will be discussed. The unit approach eliminates on-site application of roofing and insulation materials, and provides a durable, heat-reflecting surface. One end of the unit is concave on its interior surface so that sound is reflected from that end toward the other end, and sound originating from the other end is absorbed by perforated ceiling panels placed to transmit sound to the foam core. This is particularly useful in a classroom or other oratory application. Daylight introduced to the interior of the building through the skylight openings is controlled by a system of either motorized shades or by a window surface layer providing adjustable opacity thereby enabling selective illumination and heating. The material of which the units are constructed is waterproof, UV resistant, maintenance free, and has a long life expectancy.

Advantages of the modules over conventional construction include: more efficient use of materials, improved strength to weight ratio, lower manufacturing cost, and, fewer parts due to semi-monolithic construction.

The modular roof structure is a good thermal barrier, has few seams resulting in low thermal leakage, and requires relatively little labor for assembly and placement. Other advantages include good maintenance efficiency and no exterior surface finishing or refinishing requirement.

The details of one or more embodiments of these concepts are set forth in the accompanying drawings and the description below. Other features, objects, and advantages of these concepts will be apparent from the description and drawings, and from the claims.

BRIEF DESCRIPTION OF THE SEVERAL VIEWS OF THE DRAWING

Like reference symbols in the various drawings indicate like elements.

DETAILED DESCRIPTION

Figure 1:
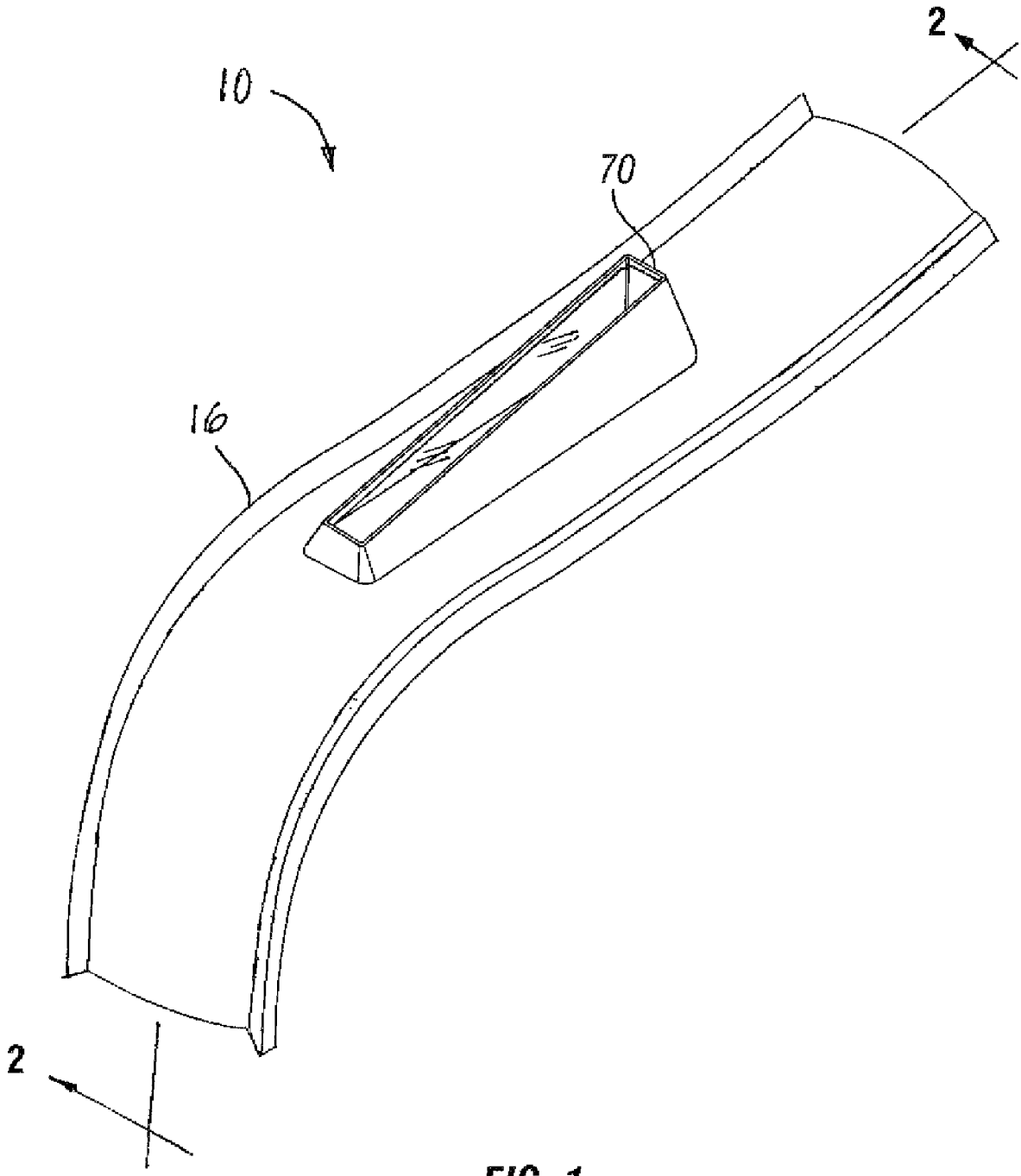
FIG. 1 is an example top perspective view of the presently described roof unit.
Figure 2:
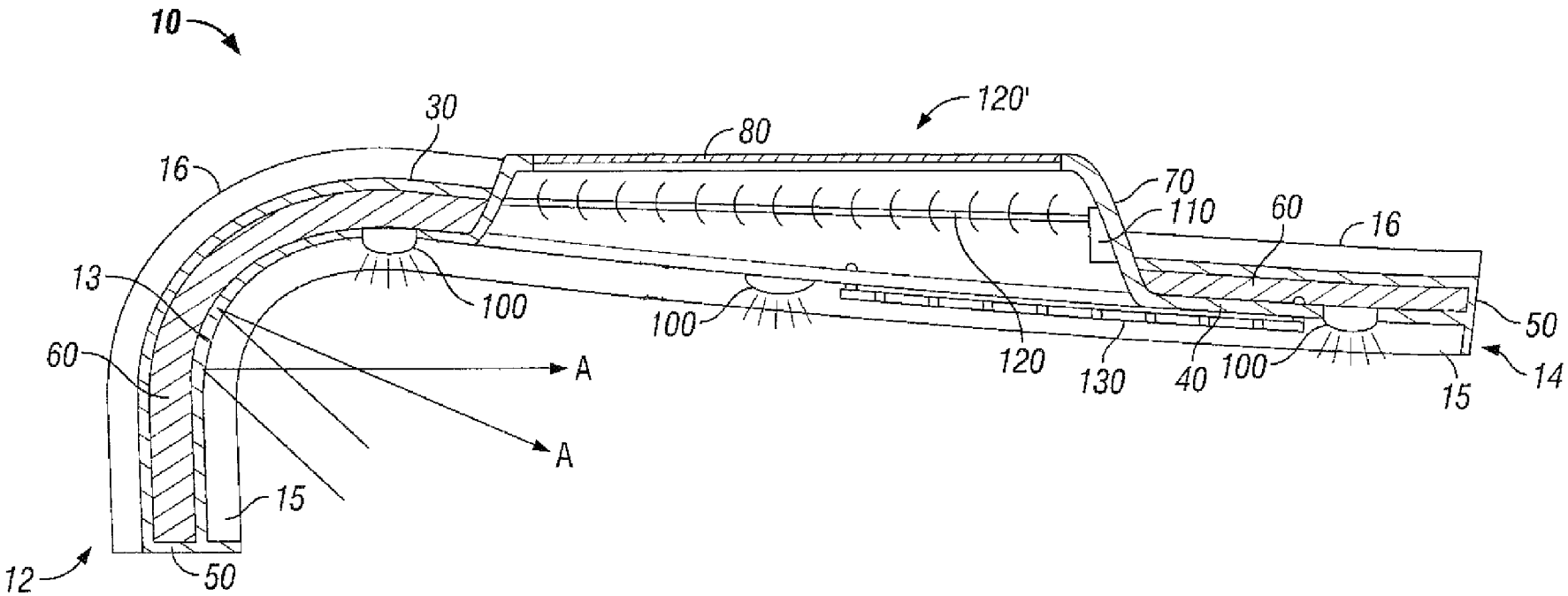
FIG. 2 is an example longitudinal sectional view thereof taken along cutting plane line 2-2 in FIG. 1.

Referring now to the drawing figures described above, FIG. 1 illustrates a roof unit 10 according to the present disclosure. As illustrated in FIG. 2, unit 10 may be made-up of a pair of spaced-apart rigid fiberglass sheets or skins, an upper skin 30 and a lower skin 40, which may be joined and sealed along their mutual peripheral edges 50 on all sides to form a closed container having a doubly-curved, longitudinally and laterally, monocoque design which may have a thermal insulation material 60 positioned within, that is, between the skins 30, 40. One end 12 of unit 10 may extend downwardly in an arc as shown. A skylight frame 70 may also be formed of fiberglass sheets integral with the skins 30, 40 and may protrude upwardly above the upper skin 30. The skylight frame 70 may support an upwardly facing transparent or semi-transparent window 80 which may be of glass or a glass substitute such as polycarbonate plastic (Lexan®). The upper skin 30 provides raised side edge portions 16 which extend the full length of unit 10. When rain falls onto unit 10 it is channeled by and along the raised portions 16 so that it does not pool but rather moves longitudinally to drain off unit 10 at the one end 12 and the opposite end 14. This provides the advantage of enabling a lighter construction since rain loading is avoided on the top of unit 10 and also avoids transferring rain load stresses to supporting structures. Likewise, snow and ice tend to slide off the top surface of unit 10 due to its non-horizontal attitude and curvature.

Roof unit 10 may be bolted or otherwise attached to frame 20 (FIG. 3) which is robustly constructed for supporting the weight of unit 10 plus any loading thereupon.

The downward arc of unit 10 at the one end 12 establishes a curved inner surface 13 of the lower skin 40, the curved inner surface 13 having a shape and smoothness that reflects incident sound which then travels toward an opposing end 14 as shown by arrows "A" in FIG. 2.

Figure 3:
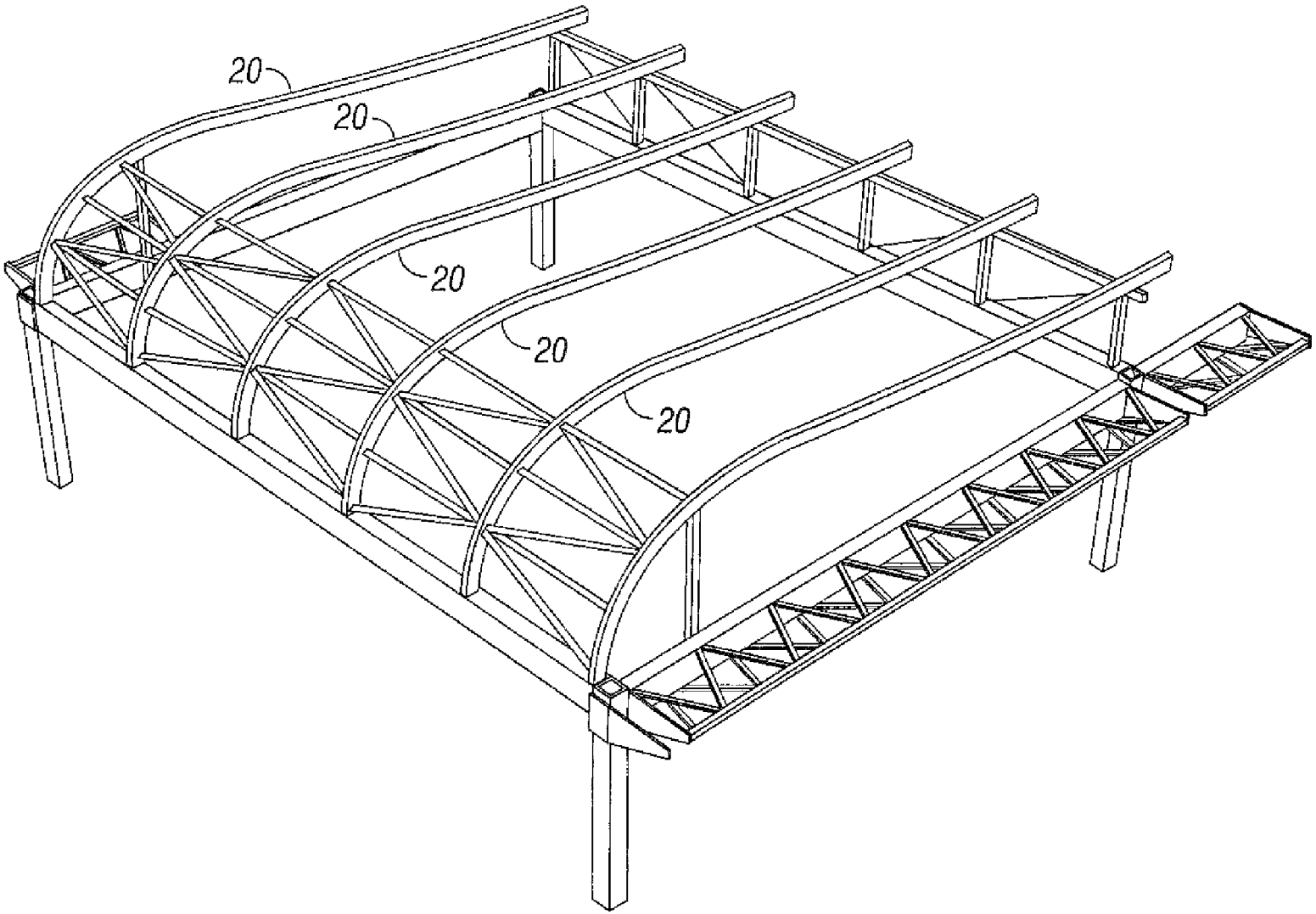
FIG. 3 is an example top perspective view of a building frame structure capable of supporting said roof units in side-by-side positions.
Figure 6:
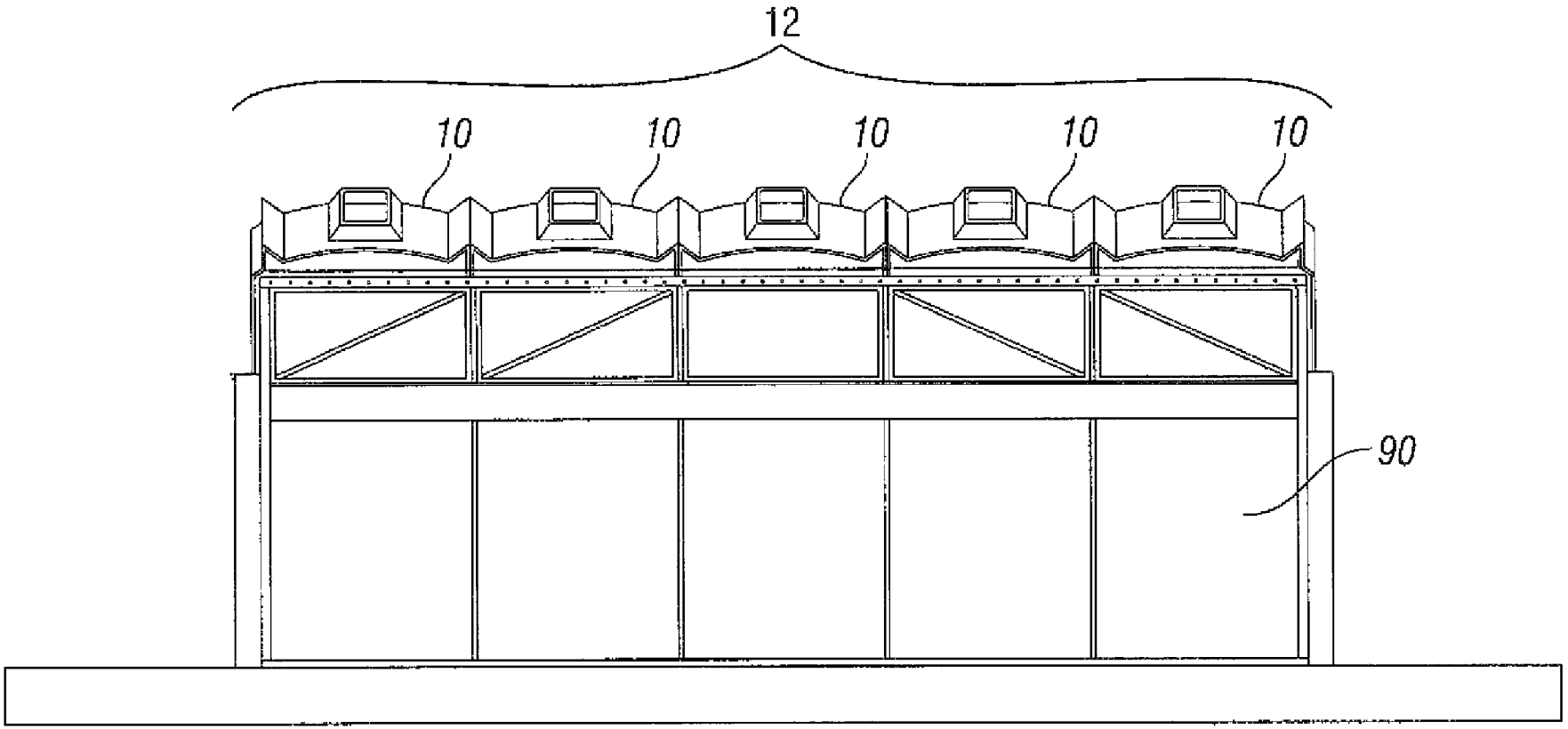
FIG. 6 is an example front elevational view of several of said roof units joined in side-by-side positions and mounted on a building structure.

FIG. 3 illustrates plural frames 20 which may be mutually bolted together or otherwise joined to support a modular roof 12 made up of plural units 10 in the manner shown in FIG. 6 where units 10 may be bolted together in side-by-side positions with the mutual joints sealed by elastic caulking material or the like. Units 10 may be bolted together through adjoining flanges 15 which are best seen in FIG. 2.

Figure 4:
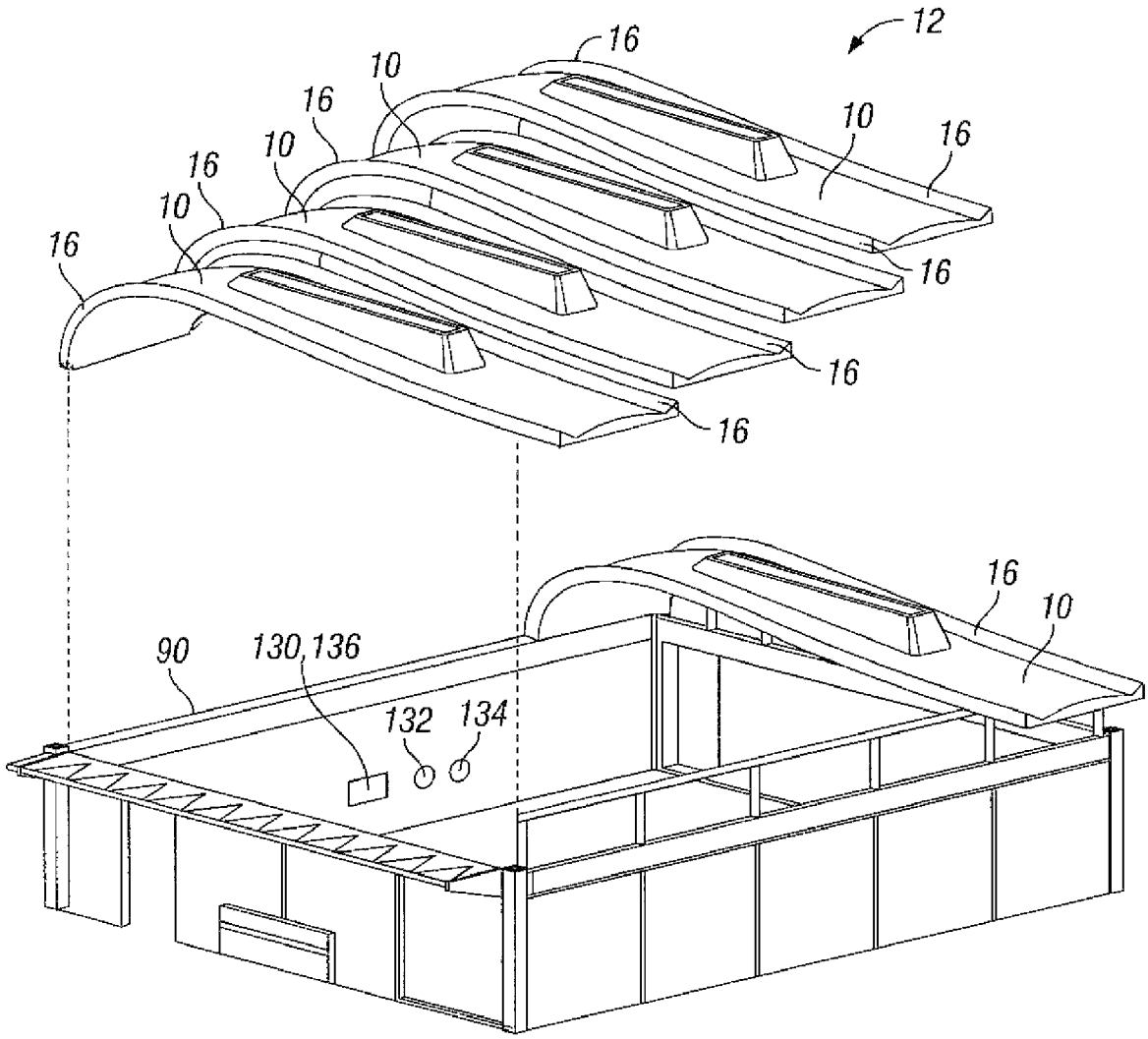
FIG. 4 is an example perspective exploded view showing plural said roof units in positions for covering a building structure wherein the frame structure of FIG. 3 is omitted for improved understanding.
Figure 5:
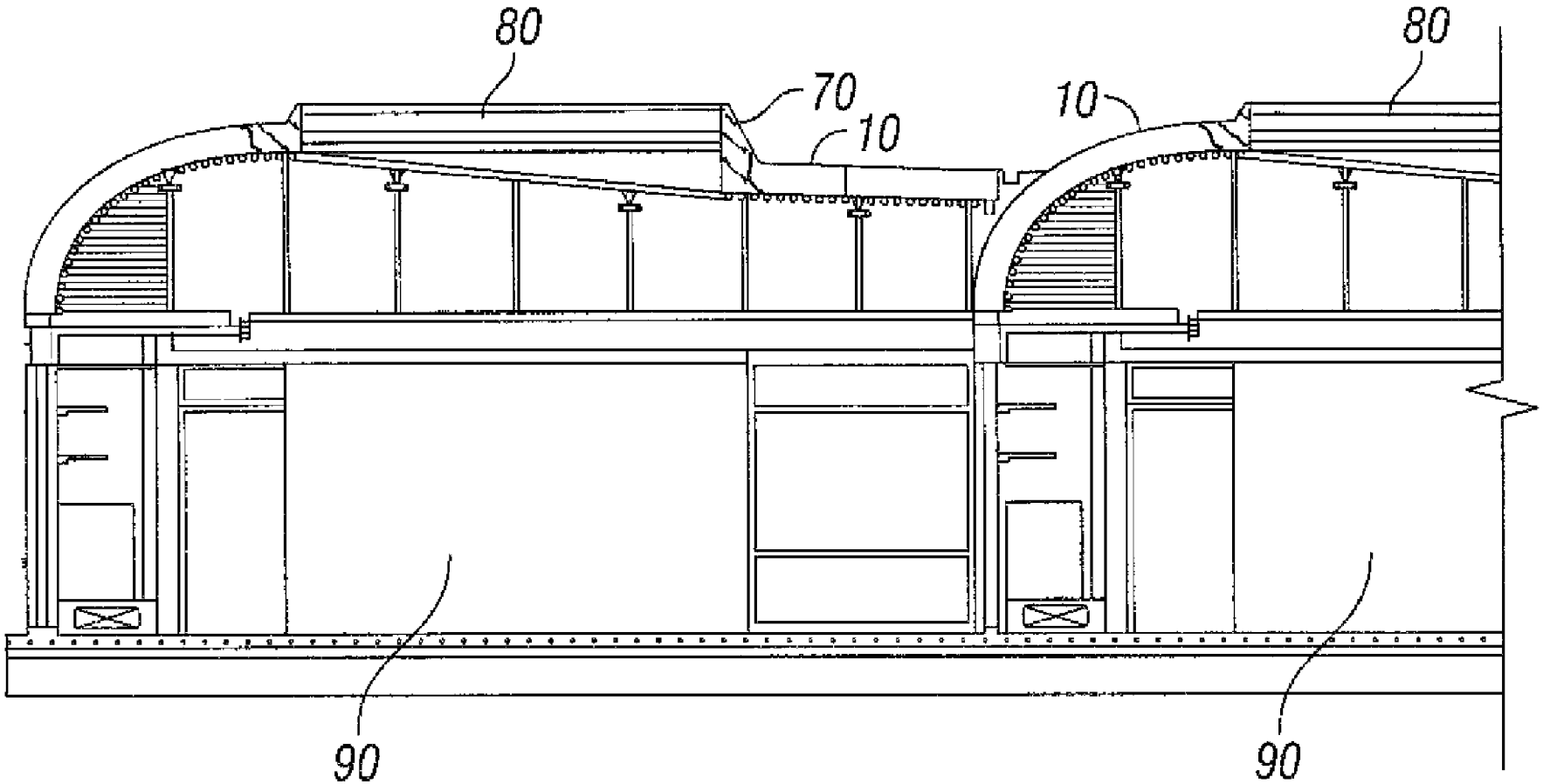
FIG. 5 is an example side elevational view of said roof units positioned on adjacent building structures, portions of the roof units cut-away in order to show detail.

FIG. 4 illustrates a possible arrangement of plural roof units 10 as they may be oriented for covering a building structure 90. Such a modular roof 12 may be generally horizontally disposed as shown and may utilize as many of roof unit 10 as are necessary to fully cover building structure 90. Because of its modular make up, roof 12 may be later expanded or reduced in extent by adding or removing one or more of units 10.

Figure 7:
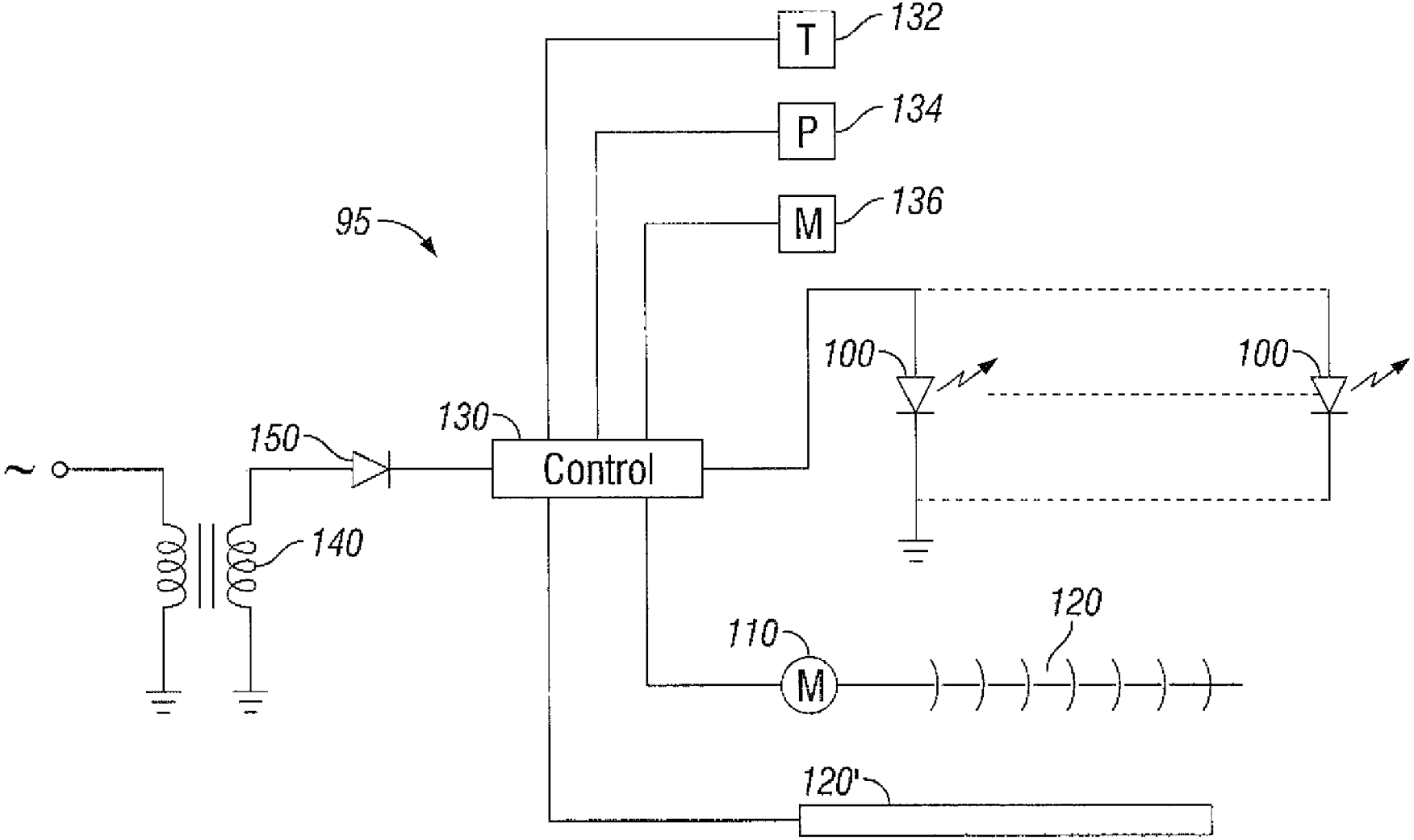
FIG. 7 is an example schematic diagram of an electrical circuit used with one or more of said roof units.

Each one of roof units 10 may incorporate an electrical circuit 95 as shown in FIG. 7. Alternatively, modular roof 12 may incorporate a single or plural electrical circuits 95 to serve the plural units 10 that make up roof 12. As shown in FIG. 7, electrical circuit 95 may take power from a conventional AC source and adjust its voltage through transformer 140 and rectify it through a rectifier 150 which may be a diode as shown, or a Wheatstone bridge rectification circuit stage (not shown), etc. DC power is received at control circuit 130 which may be any one of a wide range of conventional commercial programmable controls such as the Panasonic Electric Works PLC model AFPX-C14R. Inputs to the control circuit 130 include one from a thermostat "T" 132, another from a photodetector "P" 134 and a third from a manual set-point adjust and override sub-circuit unit 136. Output DC currents from control circuit 130 are directed to lamps 100 and a shading device such as a motorized (motor "M" 110) venetian blind 120, and/or a liquid crystal shading device 120' (see FIG. 2) Liquid crystal shading device 120' may be of the type described in U.S. Pat. No. 4,899,503 to Baughman et al which is hereby incorporated by reference herein in its entirety. Baughman et al discloses an electro-optical shade of adjustable light transmittance as an integral part of a dual-pane thermal window unit. Advantageously, the window unit is resistant to radiation heating and also heat conduction between the exterior and interior of a building. The window unit comprises two nonintersecting and, preferably, substantially parallel, spaced apart window panes, mounted in a window frame, a first of the panes having affixed thereto a first wall of an electro-optical liquid crystal cell providing a selected light transmittance, and a second of said panes delimiting, with a second wall of said cell, a space which provides a thermal break. Such a unit 120' may be positioned in FIG. 2 where unit 120 is shown.

As shown in FIG. 2, lamps 100 may be mounted and positioned for directing illumination downwardly into building structure 90. The lamps 100 may be of the type that utilizes a light emitting diode (LED). Motor 110 may be a DC reversible motor capable of opening and closing blind 120 while adjusting it to any degree of closure desired in order to adjust the amount of ambient light that enters structure 90 through window 80. Control circuit 130 is able to operate motor 110 for this purpose. Blind 120 and or 120' may be mounted within the skylight frame 70 as shown in FIG. 2. All, or only some of the roof units 10 of the modular roof 12 may incorporate blind 120/120' depending upon the amount of light that is desired to be allowed or limited to enter the structure 90. FIG. 4 shows that the control circuit 130 may be wall mounted and may enable the adjustment of the brightness of lamps 100 possibly by phase control. Since control 130 is able to monitor the ambient temperature (thermostat 132) as well as the ambient brightness (photodetector 134) within structure 90 it may be programmed to automatically adjust both variables. Assuming that control 130 has a built-in clock and calendar, it may be programmed to fully open blind 120/120' at dawn and close at nightfall. It may be further programmed to cease operations on weekends or holidays, etc. Through the manual override 136, the blind 120/120' may be closed for darkening the interior at will. When the blind 120/120' is fully open or transparent but insufficient lighting is detected by photodetector 134, control 130 may increase the output of lamps 100 to make up the difference. Control is also possible for ambient temperature within the interior of structure 90. When the ambient temperature moves out of a set point range at thermostat 132, the blind 120/120' may be opened or closed to allow more or less interior solar heating. The control of room temperature and illumination is easily adjusted with DC circuit automation as is known in the art.

Embodiments of the subject apparatus and method of use have been described herein. Nevertheless, it will be understood that various modifications may be made without departing from the spirit and understanding of this disclosure. Accordingly, other embodiments and approaches are within the scope of the following claims.

What is claimed is:

1. A monocoque roof unit comprising:

upper and lower spaced apart skins forming an open space therebetween, the skins joined at peripheral edges thereof;

the skins having a horizontal linear portion;

the skins further having a parabolic portion wherein the upper and lower skins are in mutually parallel alignment and extend downwardly from the horizontal linear portion;

the upper one of the skins having a convex exterior surface between opposing lateral edges of the peripheral edges;

the convex exterior surface terminating with raised portions at the lateral edges;

whereby, rain falling on the upper one of the skins is preferentially channeled toward and along the raised portions and whereby sound produced below the lower one of the skins is preferentially focused longitudinally by the parabolic portion.

2. The roof unit of claim 1 wherein a longitudinally aligned and upwardly extending rectangular portion of the lower one of the skins is characterized as a skylight frame protruding above the convex exterior surface;

whereby light is able to pass through the skylight frame over a longitudinal area below the roof unit.

3. The roof unit of claim 2 further comprising a shading means secured within the skylight frame.

4. The roof unit of claim 3, wherein the shading means is an adjustable density liquid crystal layer on a glazing layer.

5. The roof unit of claim 3 wherein the shading means is at least one of thermostatically and photometrically controlled.

* * * * *